US006161732A

United States Patent [19]

Albini

[11] Patent Number: 6,161,732

[45] Date of Patent: Dec. 19, 2000

[54] PUSH-BUTTON COMPRISING A MOVABLE NOZZLE FOR DISPENSING PRESSURIZED FLUIDS

[76] Inventor: Giovanni Albini, Via Montegani 19, 20141 Milan, Italy

[21] Appl. No.: 09/462,501

[22] PCT Filed: Jul. 2, 1998

[86] PCT No.: PCT/EP98/04092

§ 371 Date: Jan. 24, 2000

§ 102(e) Date: Jan. 24, 2000

[87] PCT Pub. No.: WO99/04906

PCT Pub. Date: Feb. 4, 1999

[30] Foreign Application Priority Data

Jul. 24, 1997 [IT] Italy ..... MI97A1761

[51] Int. Cl.[7] ..... B05B 1/32

[52] U.S. Cl. ..... 222/321.3; 222/380; 222/494; 222/496; 239/570

[58] Field of Search ..... 222/321.3, 380, 222/494, 496, 321.7, 321.8, 321.9; 239/570, 583, 333, 473

[56] References Cited

U.S. PATENT DOCUMENTS

| | | | |
|---|---|---|---|
| 4,182,496 | 1/1980 | Burke | 222/380 X |
| 4,515,315 | 5/1985 | Corsette . | |
| 4,830,284 | 5/1989 | Maerte | 239/333 |
| 5,042,697 | 8/1991 | Warren | 222/402.1 |
| 5,181,656 | 1/1993 | Behar | 222/380 X |
| 5,195,665 | 3/1993 | Lina | 222/380 X |
| 5,558,258 | 9/1996 | Albini et al. | 222/380 X |
| 5,657,930 | 8/1997 | Battegazzore | 239/333 |
| 5,842,616 | 12/1998 | Ruscitti et al. | 222/380 X |
| 5,988,449 | 11/1999 | Fuchs et al. | 222/189.11 |

FOREIGN PATENT DOCUMENTS

| | | |
|---|---|---|
| 0 686 433 | 12/1995 | European Pat. Off. . |
| 1 226 565 | 3/1971 | United Kingdom . |
| WO 89 01365 | 2/1989 | WIPO . |

*Primary Examiner*—Kenneth Bomberg
*Attorney, Agent, or Firm*—Oblon, Spivak, McClelland, Maier & Neustadt, P.C.

[57] ABSTRACT

A push-button applicable to the stem (3) of a pump (4) for delivering liquids or creams under pressure. The push-button includes a cylindrical cavity into which there extends a shutter (10), the free end of which lies opposite a discharge nozzle (8) formed in an elastically flexible body (7) secured to a piston (13) movable on the shutter (10) by the effect of the pressure delivered by the pump.

7 Claims, 3 Drawing Sheets

PUSH-BUTTON COMPRISING A MOVABLE NOZZLE FOR DISPENSING PRESSURIZED FLUIDS

This Application is a National Stage Application filed under 35 USC 371 of PCT/EP98/04092 filed Jul. 2, 1998.

BACKGROUND OF THE INVENTION

1. Field of the Invention

This invention relates to a push-button for dispensing atomized liquids or creams under pressure through a nozzle provided in an elastically flexible body which is deformable, under the thrust of a pressurized liquid or cream originating from the stem of a pump, from a rest position in which the nozzle is closed by the end of a fixed shutter, to a dispensing position in which the nozzle has moved away from said end of the shutter.

2. Discussion of the Background

To dispense liquids in atomized form or pressurized creams, pumps are used having a stem on which there is mounted a push-button comprising a chamber into which the pressurized fluid arrives from the pump stem, this fluid being expelled to the outside via a discharge nozzle within which (if the fluid is a liquid) one or more profiled channels converge to impress a strong vorticose movement on the liquid before being expelled to the outside.

To achieve optimum atomization and prevent liquid dripping from the outside of the nozzle, this nozzle must be opened only when the pressure of the liquid reaching it exceeds a predetermined minimum value. The same requirement also exists if the fluid to be dispensed is a creamy substance.

The known art describes various types of push-buttons to be fitted onto the stems of pumps, in particular for delivering pressurized liquids, the purpose of such push-buttons being to achieve the aforesaid optimum atomization.

The U.S. Pat. No. 4,182,496 describes a push-button having a chamber communicating with the cavity within the stem and defined by a plug comprising within it the discharge nozzle which, when under rest conditions, is closed by the end of an appendix projecting from a piston sealedly movable—against the thrust of a spring—within said chamber. The pressurized liquid originating from the pump stem fills said chamber to cause the piston to move, so compressing the spring and freeing said nozzle, which however opens gradually with the result that liquid drips from the nozzle both when the nozzle is opened and closed.

European patent EP-A-0688608 describes a push-button (which obviates the drawbacks of the aforesaid US patent) in which the piston movable within the chamber in the push-button, is sealedly inserted into a cylindrical hole in a supplementary body housed in the chamber. The piston is released from this hole only after the end of the appendix—or shutter—projecting from the piston has withdrawn from the discharge nozzle, which is hence completely free when pressurized liquid is fed to it. The push-button of EP-A-0688608 has the drawback that the piston is traversed by a hole which connects together the two sides of the piston seal lip, so that it is practically impossible to prime the push-button at the moment of its initial use, whereas atomized liquid delivery ceases immediately on cessation of the pressurized liquid feed through the pump stem.

The U.S. Pat. No. 5,558,258 and the corresponding patent EP-A-0686433 describe a push-button similar to that of EP-A-0688608 but differing from it in that the piston seal lip is not holed, and in which the pressurized liquid originating from the pump stem is delimited by this seal lip, so that all the liquid present in the push-button chamber is expelled in atomized form under pressure, even when the arrival of pressurized liquid through said stem ceases.

Finally, patent application EP-A-0754499 describes a push-button similar to that of U.S. Pat. No. 5,558,258 but in which a lever system is provided for mechanically withdrawing the piston and for opening the discharge nozzle to allow expulsion of the air present in the push-button chamber at the moment of its initial use, ie at the moment in which the push-button is primed.

All the aforesaid known push-buttons have the drawback of being constructed by assembling at least five component parts, which considerably affects their production and assembly cost, it being easy to understand the difficulty involved in correctly and quickly assembling a relatively large number of component parts of very small dimensions.

SUMMARY OF THE INVENTION

The main object of this invention is therefore to provide a pushbutton to be fitted onto the stem of a pump for delivering pressurized liquids or creams, which is very economical by consisting of only three easily produced component parts connectable together at high speed.

A further object is to provide a push-button which enables the liquid or cream present within the push-button to be delivered always and only at a pressure exceeding a predetermined minimum value, so as to prevent any dripping of the dispensed liquid or to prevent the exit of cream at too low a pressure from the pushbutton nozzle.

These and further objects are attained by a push-button for dispensing pressurized fluid substances comprising a main body having a chamber bounded by an at least partly cylindrical lateral wall and closed at one end by a profiled member in which a discharge nozzle for the pressurized fluid is formed, an at least partly cylindrical elongate body extending into said chamber and from which there projects an appendix the free end of which is positioned in front of said nozzle, a piston housed in and movable within said chamber and having at least one lip sealedly slidable along the cylindrical surface of said chamber, elastic means acting on said piston to maintain said appendix and said nozzle urged towards each other to sealedly close the nozzle when in its rest state, in the main body there being provided a seat for housing the free end of the stem of a pump for delivering a pressurized liquid, this seat being in open communication with said chamber at a point such that pressurized liquid arriving in the chamber acts on said piston in the opposite direction to that in which said elastic means act, characterised in that said elastic means consist of flexible fins projecting from the profiled member in which said nozzle is formed, and having their free ends abutting against said main body, from said profiled member there projecting a tubular sleeve with which the adjacent end of said piston sealedly engages, said elongate body being integral with said main body, said piston having at least one lip sealedly slidable along the cylindrical surface of the elongate body, the surface of said elongate body being shaped in proximity to its appendix in such a manner as to prevent the piston lip sealing against it and allow pressurized fluid to pass from said chamber to said nozzle.

Preferably said elongate body projects from the wall which bounds that end of said chamber distant from the end closed by said profiled member.

Again preferably, said appendix has an at least partly cylindrical surface against which a lip projecting from said piston sealedly abuts, at least one aperture being provided to connect said nozzle to that portion of said chamber situated in correspondence with that end of said elongate body from which said appendix projects.

BRIEF DESCRIPTION OF THE DRAWINGS

In order to clarify the understanding of the structure and characteristics of the push-button according to the invention, a preferred embodiment thereof is described hereinafter by way of non-limiting example with reference to the accompanying drawings, on which.

DESCRIPTION OF THE PREFERRED EMBODIMENTS

Figure 1:
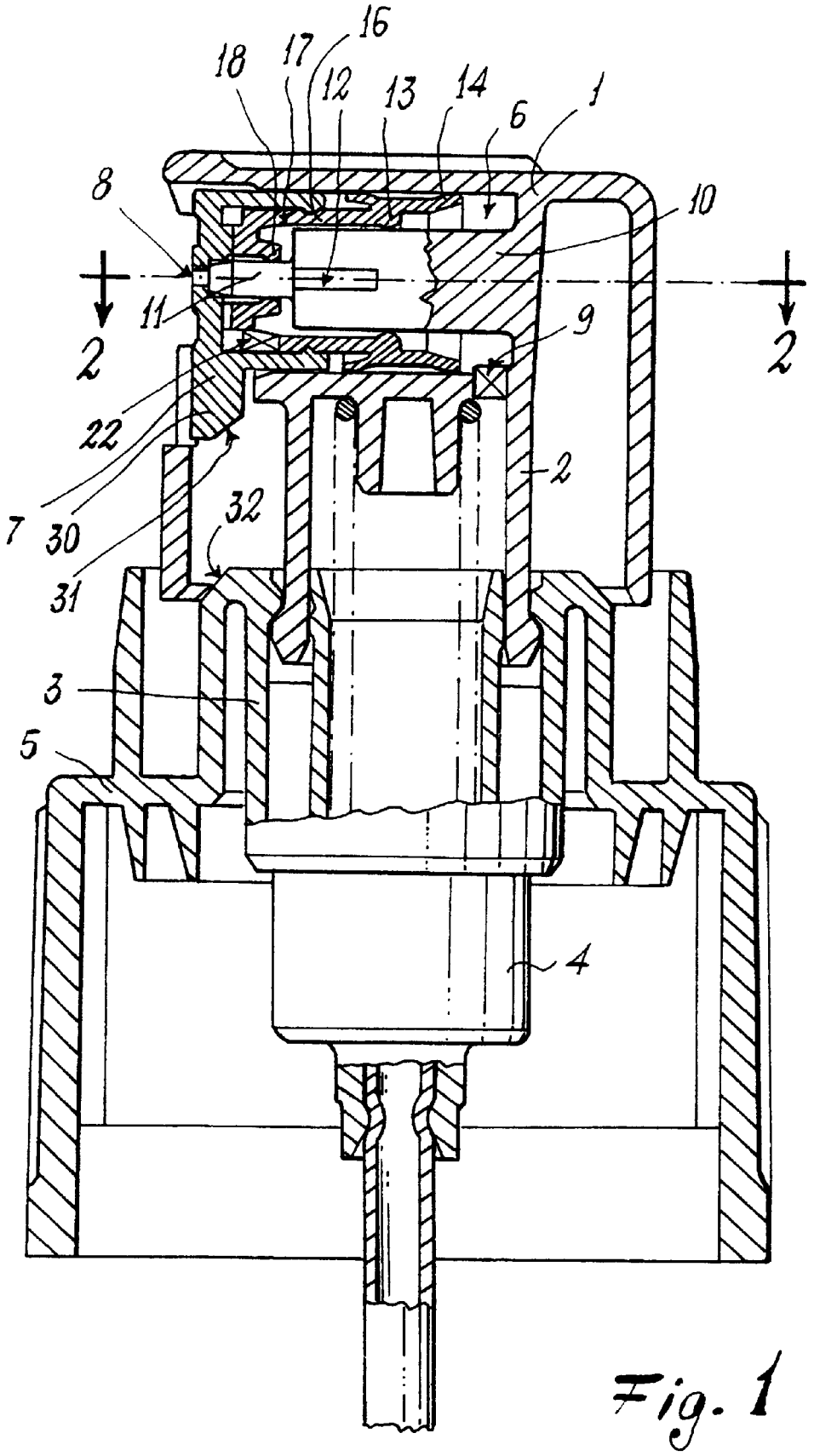
FIG. 1 is a section through the push-button taken on a plane passing through the longitudinal axis and through the discharge nozzle of the push-button, which is shown mounted on the stem of a pump.
Figure 2:
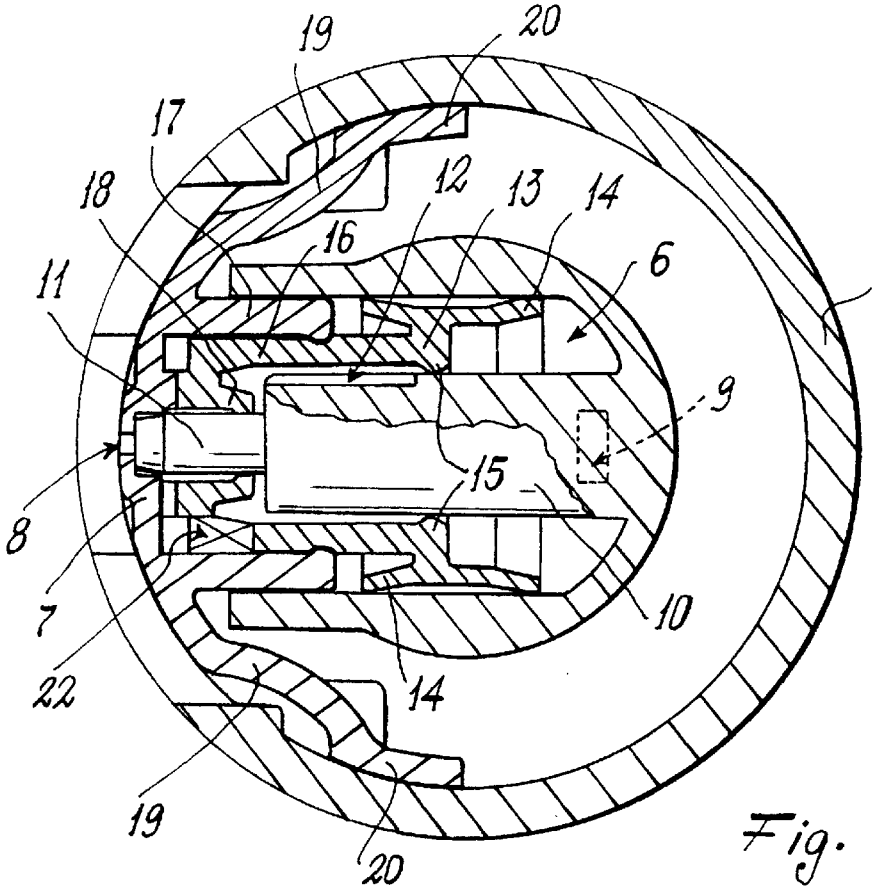
FIGS. 2 and 3 are cross-sections through the push-button to an enlarged scale, taken on the line 2—2 of FIG. 1, with the pushbutton shown in the position in which the nozzle is at rest or closed and, respectively, in the position in which the nozzle is open.
Figure 3:
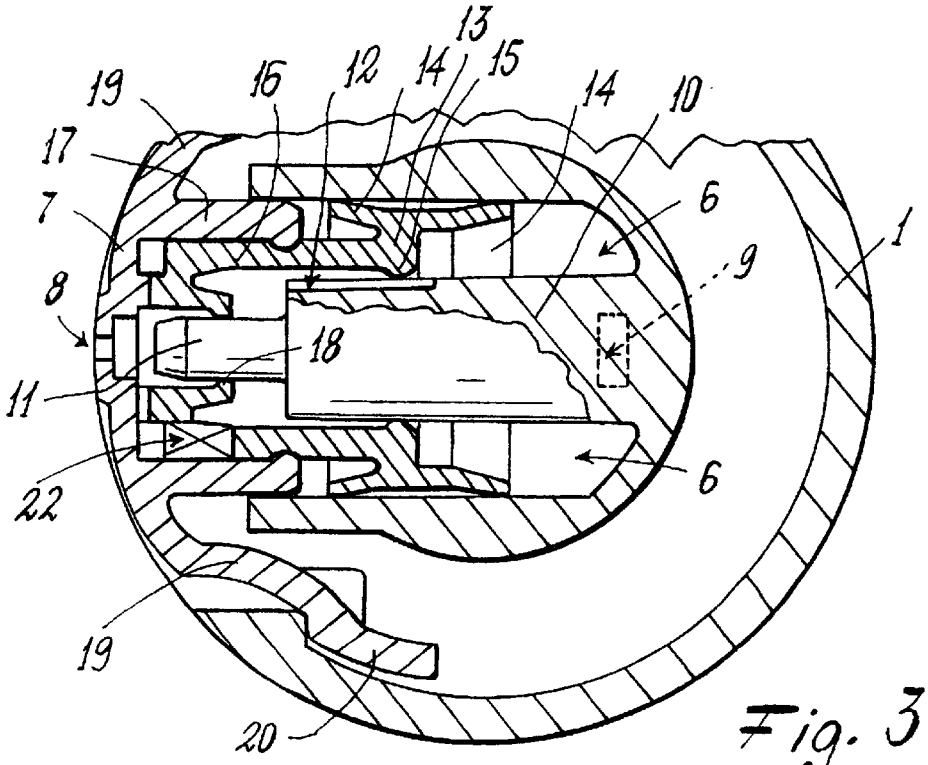

FIGS. 1 to 3 show a dispensing push-button comprising a main body 1 provided with a seat bounded by a tubular wall 2 into which thee can be sealedly inserted the free end of the stem 3 of a mechanical pump 4 of any type, able to deliver liquids under pressure each time it is operated manually. The pump 4 can be secured in known manner by a ring cap 5 onto the mouth of a bottle or container (not shown) containing the liquid to be dispensed.

In the main body 1 there is provided a chamber 6 bounded by a cylindrical lateral wall, an end wall and, respectively, a profiled member 7 in which a nozzle 8 is formed, through which the atomized liquid dispensed by the push-button is discharged to atmosphere. The chamber 6 communicates with the cavity defined by the tubular wall 2 via a hole 9 provided in proximity to the end wall of the chamber 6.

From the end wall of the chamber 6 there projects an elongate cylindrical wall 10 which extends into said chamber 6 and from which there projects an appendix 11 of diameter less than the diameter of the body 10, and having its free end positioned in front of the nozzle 8. From FIG. 1 it can be seen that in the body 10 there are provided longitudinal grooves 12 (only one of which is visible in the figure) which extend from an intermediate region along the length of said body 10 until they open towards the appendix 11, ie at that end of the body 10 which faces the appendix 11.

The chamber 6 houses a movable piston 13 from which two lips 14 project outwards to seal against the cylindrical surface of the chamber 6. From the piston 13 there also projects an internal seal lip 15 which rests against and is sealedly slidable along the cylindrical surface of the body 10, from said piston there also projecting a tubular wall 16 having in its outer surface an annular groove by which it sealedly engages an annular rib projecting inwards from a tubular sleeve 17 which extends from the member 7 internal to the tubular wall 16, totally about the nozzle 8. From all figures it can be seen that from the tubular wall 16 there projects an annular lip 18 against which the cylindrical smooth surface of the appendix 11 can sealedly slide.

The member 7 is constructed of plastic material of elastically deformable type, and is substantially in the form of an elongate disc with flexible fins 19 projecting from one and the other side of the nozzle (FIGS. 2 and 3). The ends 20 of these fins press against and are slidable along corresponding inclined surfaces provided in the interior of the push-button 1. The fins 19, 20 are preloaded and behave in practice as leaf springs, tending to maintain the member 7 and with it the piston 3 urged into the rest position shown in FIGS. 1 and 2 in which the member 7 is urged against the appendix 11, the free end of which sealedly closes the nozzle 8, whereas the piston lip 15 is positioned in contact with the smooth surface of the body 10, where grooves 12 are not present. Under these conditions, any liquid present in that portion of the chamber 6 to the right (with respect to the figures) of the seal lip 15 is hermetically sealed and cannot emerge from the nozzle 8.

When the liquid or a cream is fed under pressure through the cavity of the stem 3 and the hole 9 to the chamber 6, as soon as this pressure is sufficient to overcome the resistance offered by the elastic fins 19 of the member 7, the piston is moved towards the left (again with respect to the figures) to firstly free the nozzle 8 and then to superpose the piston lip 15 on the grooves 12 of the body 10 (FIG. 3). In this manner the pressurized liquid passes through the grooves 12 to suddenly fill that chamber portion within the tubular wall 16, then pass through one or more apertures 22 provided in the tubular wall to penetrate into a turbulence chamber (for simplicity not numbered) provided between the opposing surfaces of the tubular wall 16 and of the member 7, to be violently expelled in finely atomized form through the discharge nozzle 8. During the movement of the member 7 and piston 13 towards the left, the ends 20 of the fins 19 slide in contact with the inclined surfaces of the body 1, the fins 19 bending elastically.

As soon as the pressure of the liquid or cream present in the chamber 6 decreases below a predetermined value, the elastic thrust exerted by the fins 19 on the body 1 causes rapid rightward movement of the piston, the lip 15 of which becomes positioned beyond the grooves 12 (preventing flow of low-pressure liquid towards the nozzle) and, immediately afterwards, that portion of the member 7 comprising the nozzle 8 bears against the end of the appendix 11, which hence seals the nozzle (FIG. 2).

As can be seen from FIG. 1, from the lower edge of the member 7 there projects a tooth 30, the downwardly facing surface 31 of which is inclined. When the push-button is pressed completely downwards, the inclined surface 31 abuts against a corresponding inclined surface 32 provided on the ring cap 5 or directly against that edge of the ring cap which fixes the pump 4 onto the container for the fluid to be dispensed. If the push-button is further lowered on the ring cap, the inclined surface 31 sides along the surface 32 to result in leftward sliding (with respect to FIG. 1) of the member 7, the nozzle 8 of which hence becomes mechanically withdrawn from the free end of the appendix 11. In this manner any compressed air present in the chamber 6 can be expelled to the outside, and the push-button can be easily primed.

Those members which mechanically move the member 7 to enable the push-button to be primed can be constructed differently from the aforedescribed and can, for example, comprise a supplementary lever rotating on a fulcrum and engaging the member 7 to cause it to move mechanically.

Figure 4:
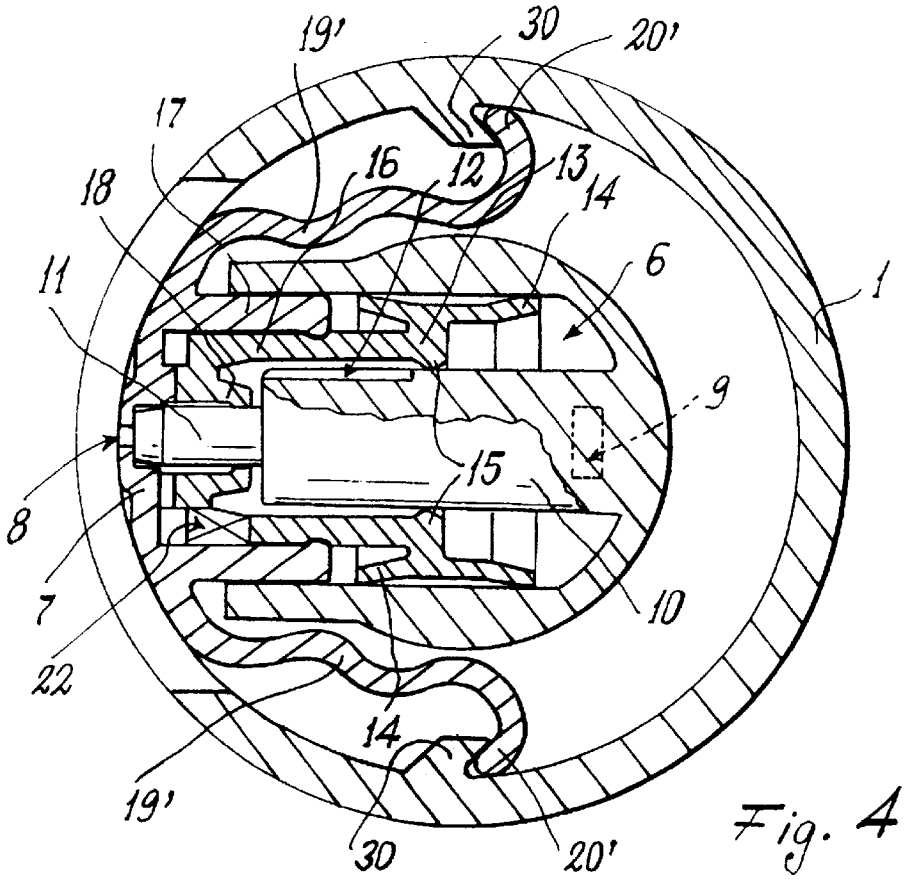
FIGS. 4 and 5 are similar to FIGS. 2 and 3, but show a different embodiment of the dispensing push-button.
Figure 5:
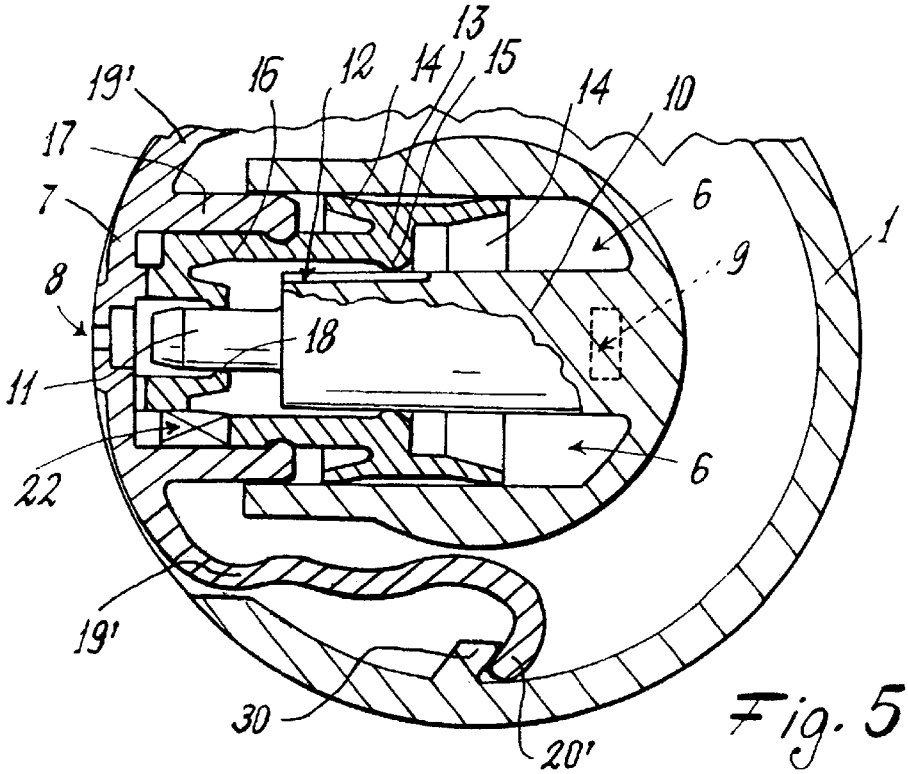

FIGS. 4 and 5 show two sections (totally similar to FIGS. 2 and 3) through a different embodiment of the dispensing push-button. In these figures, for simplicity the same reference numerals used in FIGS. 2 and 3 are used to represent the same structural parts, which are not further described herein.

The embodiment of FIGS. 4 and 5 differs from that already illustrated in that from the member 7 there project two flexible fins 19', the free ends 20' of which are hooked to teeth or ribs 30 projecting from the body 1, said fins 19' having an undulated profile (clearly visible on the drawings) causing them to act as preloaded springs which maintain the member 7 urged against the end of the appendix 11 when in the rest state (FIG. 4) and which relax to extend (FIG. 5) when fluid is dispensed.

Alternatively, only the curved end part of the fins could be made flexible, or the end of the fins could be hooked to flexible appendices forming part of the body 1 and projecting towards its interior.

From the aforegoing description certain important characteristics of the described push-button are apparent, including: the presence of only three easily constructed and assembled component parts; the fact that when the push-button is operated the discharge nozzle initially opens, but the liquid can be fed to the nozzle only later when the pressure in the chamber 6 upstream of the lip 14 stabilizes at a value exceeding the predetermined minimum value; and the fact that by a simple modification of the member 7, it can be operated mechanically to move it away from the nozzle closure position to allow easy priming of the push-button.

The body 1 can be shaped in the manner of a normal cap of the type used to spray atomized liquids into the environment or to dispense creams under pressure, or can be of thin elongate shape for use as a nasal dispenser.

What is claimed is:

1. A push-button for dispensing pressurized fluid substances comprising a main body having a chamber bounded by an at least partly cylindrical lateral wall and closed at one end by a profiled member in which a discharge nozzle for the pressurized fluid is formed, an at least partly cylindrical elongate body extending into said chamber and from which there projects an appendix the free end of which is positioned in front of said nozzle, a piston housed in and movable within said chamber and having at least one lip sealedly slidable along the cylindrical surface of said chamber, elastic means acting on said piston to maintain said appendix and said nozzle urged towards each other to sealedly close the nozzle when in its rest state, in the main body there being provided a seat for housing a free end of a stem of a pump for delivering a pressurized liquid, this seat being in open communication with said chamber at a point such that pressurized liquid arriving in the chamber acts on said piston in an opposite direction to that in which said elastic means operate, characterised in that said elastic means consist of flexible fins projecting from the profiled member in which said nozzle is formed, and having their free ends abutting against said main body, from said profiled member there projecting a tubular sleeve with which an adjacent end of said piston sealedly engages the fins tending to maintain the profiled member and, via tubular sleeve, with it the piston urged in the rest state, said elongate body being integral with said main body, said piston having at least a second lip sealedly slidable along the cylindrical surface of the elongate body, the surface of said elongate body being shaped in proximity to its appendix in such a manner as to prevent the second piston lip sealing against it and allow pressurized fluid to pass from said chamber to said nozzle.

2. A dispensing push-button as claimed in claim 1, characterised in that said elongate body projects from a wall which bounds that end of said chamber distant from the end closed by said profiled member.

3. A dispensing push-botton as claimed in claim 1, characterised in that said appendix has an least partly cylindrical surface against which a lip projecting from the end of said piston sealedly abuts, at least one aperture being provided to connect said nozzle to that portion of said chamber situated in correspondence with that end of said elongate body from which said appendix projects.

4. A dispensing push-button as in claim 1, characterised in that the free ends of said flexible fins are hooked to teeth projecting from the main body, and deform elastically to act as a spring when the profiled member withdraws from said appendix as a result of the movement of said piston on said elongate body.

5. A dispensing push-button as claimed in claim 4, characterised in that said flexible fins have an undulated profile.

6. A dispensing push-button as claimed in claim 1, characterised in that the ends of said flexible fins press against and are slidable on corresponding surfaces of said main body which are inclined in the direction such as to force said profiled member towards the free end of said appendix.

7. A dispensing push-button as claimed in claim 1, characterised in that from said profiled member there projects at least one tooth, one surface of which opposes an operating element which interferes with that surface when the push-button is pressed completely downwards to cause mechanical movement of the profiled member, and consequent opening of said nozzle.

* * * * *